US006828883B1

(12) United States Patent
Kitajima et al.

(10) Patent No.: US 6,828,883 B1
(45) Date of Patent: Dec. 7, 2004

(54) HIGH PERFORMANCE DIELECTRIC CERAMIC FILTER

(75) Inventors: Masahiko Kitajima, Ube (JP); Hiroshi Nakamura, Ube (JP); Kosuke Nishimura, Ube (JP)

(73) Assignee: UBE Electronics, Ltd., Mine (JP)

( * ) Notice: Subject to any disclaimer, the term of this patent is extended or adjusted under 35 U.S.C. 154(b) by 0 days.

(21) Appl. No.: 09/528,670

(22) Filed: Mar. 20, 2000

Related U.S. Application Data

(63) Continuation-in-part of application No. 09/528,431, filed on Mar. 17, 2000.
(60) Provisional application No. 60/147,676, filed on Aug. 6, 1999.

(51) Int. Cl.[7] ..... H01P 3/06; H01P 1/20; H01P 5/12
(52) U.S. Cl. ..... 333/206; 333/202; 333/134
(58) Field of Search ..... 333/202, 206, 333/134

(56) References Cited

U.S. PATENT DOCUMENTS 4,879,533 A 11/1989 de Muro et al.
5,250,916 A 10/1993 Zakman et al.
5,278,527 A 1/1994 Kenoun et al.
5,428,325 A * 6/1995 Jachowski et al. ..... 333/203
5,488,335 A 1/1996 Agahi-Kesheh et al.
5,712,648 A * 1/1998 Tsujiguchi ..... 333/134
5,793,267 A * 8/1998 Tada et al. ..... 333/202
5,986,521 A * 11/1999 Tada et al. ..... 333/134
6,087,909 A * 7/2000 Toda et al. ..... 333/206

* cited by examiner

*Primary Examiner*—Patricia Nguyen
(74) *Attorney, Agent, or Firm*—Maxim H. Waldbaum, Esq.; Kimberley K. Weate, Esq.

(57) ABSTRACT

A reduced size ceramic block filter has trap holes whose center is askew from the line running through the center of the transmission poles such that the height-wise distance between its center and the center line of the transmission poles is greater than (dt+d1)/2, but not greater than 3/8 of the height of the filter. The trap hole is also width-wise spaced from the next nearest transmission hole by an amount which approximates the distance between transmission holes. Due to this layout the diameter of the trap holes are reduced in order to maintain performance which is equivalent to a conventional filter whose trap holes are timely aligned with its transmission poles. The combination of reduced trap hole diameter and reduced width-wise spacing between traps and transmission holes, results in a reduced size ceramic filter.

7 Claims, 3 Drawing Sheets

HIGH PERFORMANCE DIELECTRIC CERAMIC FILTER

CROSS REFERENCE TO RELATED APPLICATION

The subject application is a continuation in part of pending U.S. patent application Ser. No. 09/528,431, filed on Mar. 17, 2000, entitled, High Performance Dielectric Ceramic Filter which claims the benefit of U.S. Provisional Application No. 60/147,676, filed on Aug. 6, 1999, and is commonly assigned with the subject application.

FIELD OF THE INVENTION

This invention relates to ceramic block filters with high performance in a small package.

BACKGROUND OF THE INVENTION

A ceramic body with a coaxial hole bored through its length forms a resonator that resonates at a specific frequency determined by the length of the hole and the effective dielectric constant of the ceramic material. The holes are typically circular, or elliptical. A dielectric ceramic filter is formed by combining multiple resonators. The holes in a filter must pass through the entire block, from the top surface to the bottom surface. This means that the depth of hole is the exact same length as the axial length of a filter. The axial length of a filter is set based on the desired frequency and available dielectric constant of the ceramic.

The ceramic block functions as a filter because the resonators are coupled inductively and/or capacitively between every two adjacent resonators. These components are formed by the electrode pattern which is designed on the top surface of the ceramic block couplings and plated with a conductive material such as silver or copper.

Ceramic filters are well known in the art and are generally described for example in U.S. Pat. Nos. 4,431,977; 5,250,916; and 5,488,335, all of which are hereby incorporated by reference as if fully set forth herein.

With respect to its performance, it is known in the art that the band pass characteristics of a dielectric ceramic filter are sharpened as the number of holes bored in the ceramic block are increased. The number of holes required depends on the desirable attenuation properties of the filter. Typically a simplex filter requires at least two holes and a duplexer needs more than three holes. This is illustrated in FIG. 1 where graph 10 represents the filter response with fewer holes than graphs 12 and 14. It is apparent that graph 14 which is the response of the filter with the most holes, is the sharpest of the three responses shown. Referring to FIG. 2, it can be seen that the band pass characteristic of a particular dielectric ceramic filter is also sharpened with the use of trap holes bored into the ceramic block. Solid line graph 21 represents the response of a filter without a high end trap. Dashed line graph 23 represents the response of the same filter with a high end trap.

Trap holes, or traps as they are commonly referred to are resonators which resonate at a frequency different from the primary filter holes, commonly referred to simply as holes. They are designed to resonate at the undesirable frequencies. Thus, the holes transmit signals at the desirable frequencies while the traps remove signals at the undesirable frequencies, whether low end or high end. In this manner the characteristic of the filter is defined, i.e. high pass, low pass, or band pass. The traps are spaced from holes a distance greater than the spacing between holes so as to avoid mutual interference between the holes and traps. As shown in FIG. 3, whereas holes 31 are separated from each other a distance equal to D, a distance of 2D is placed between trap 33 and the transmission hole nearest to trap 33. The precise distance between trap and transmission pole is one of design choice for achieving a specified performance, but it is preferably 1 to 10 mm. Traditionally, the traps will be spaced from 1.5D to 2D from the holes.

Conventionally the holes 41 and traps 43 in a ceramic filter are positioned along a straight line, as shown in FIG. 4. This design together with the spacing requirements addressed above limits the extent to which a filter may be reduced in size. Specifically, the performance characteristics of a given filter are a function of its width, length, number of holes and diameter of holes. The usual axial length L is 2 to 20 mm. The width w is determined by the number of holes. The usual width of the block filter is 2 to 70 mm. Reducing the number of holes, the diameter of the holes, or the spacing between holes, will effect the performance. Accordingly, it is desirable to have a design for a dielectric ceramic filter which can effectively reduce the size of a given filter while maintaining its given performance characteristics.

SUMMARY OF THE INVENTION

A new design for reducing the size of a given filter is achieved by reducing the diameter of the traps and moving them off center from the transmission holes while shortening the distance between the trap and the next nearest transmission hole. Thus the width of any given filter is reduced without effecting the performance of the filter. In one specific embodiment of the present invention, each trap is positioned from the next nearest transmission pole a horizontal distance of 0.8D to 1.5D, where D is the spacing between transmission poles. Each trap is also vertically spaced from the transmission poles a distance ranging from greater than one half of the sum of the diameter of the trap and the large diameter of a transmission pole and not greater than ⅜H, where H is ⅜H, where H is the height of the filter.

DETAILED DESCRIPTION OF THE INVENTION

Figure 1:
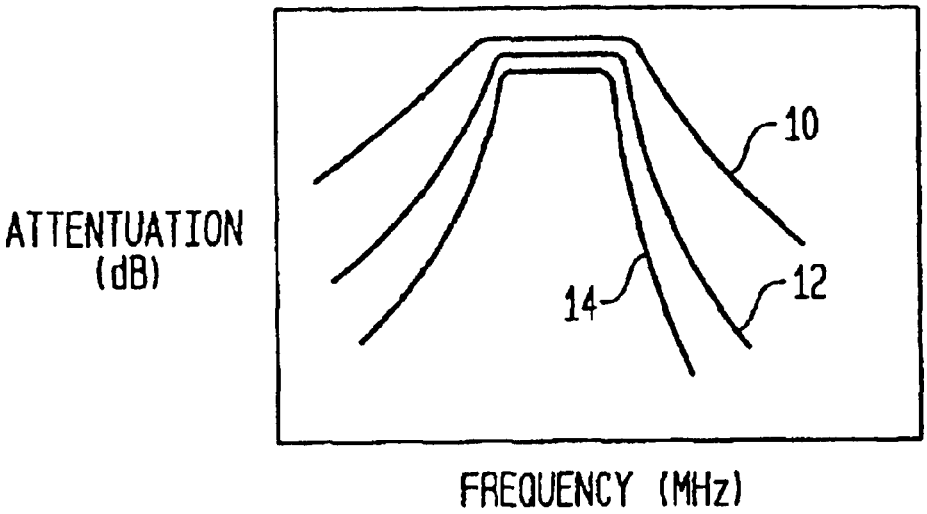
FIG. 1 illustrates the increased sharpness of the band pass response of a dielectric ceramic filter as the number of holes in the filter increase.
Figure 2:
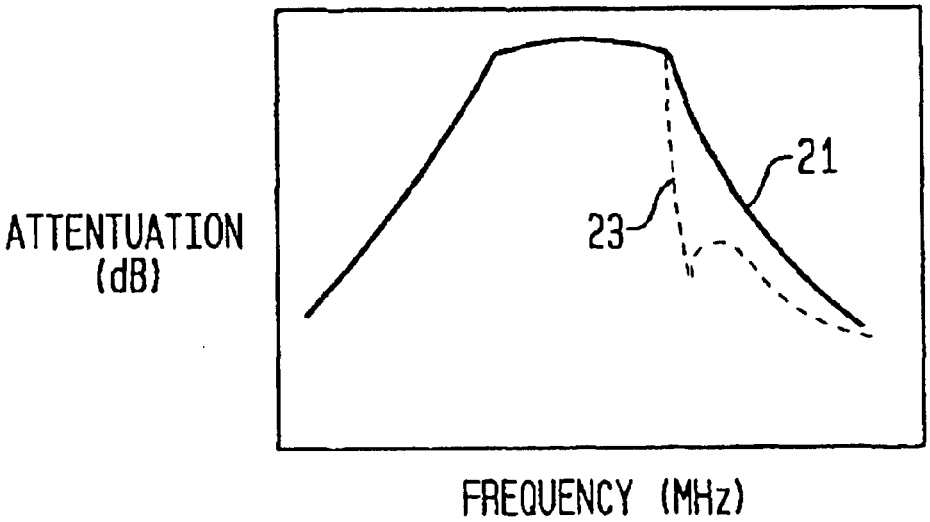
FIG. 2 illustrates the effectiveness of traps in removing high end frequencies.
Figure 3:
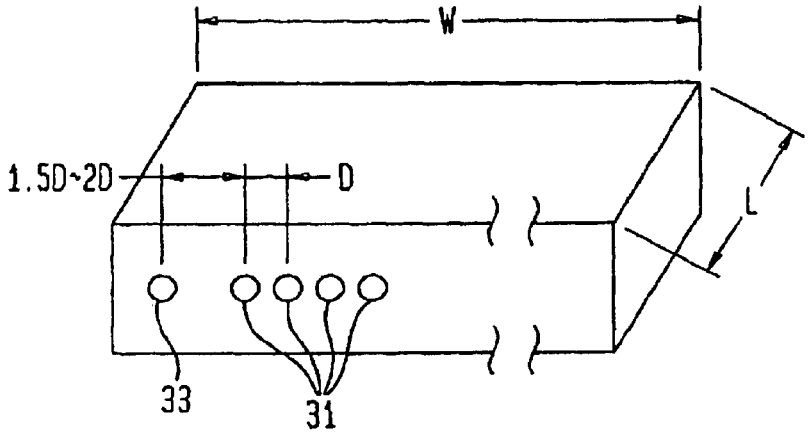
FIG. 3 (PRIOR ART)
FIG. 3 is representative of the spacing between holes and hole and trap on a conventional ceramic block filter.
Figure 4:
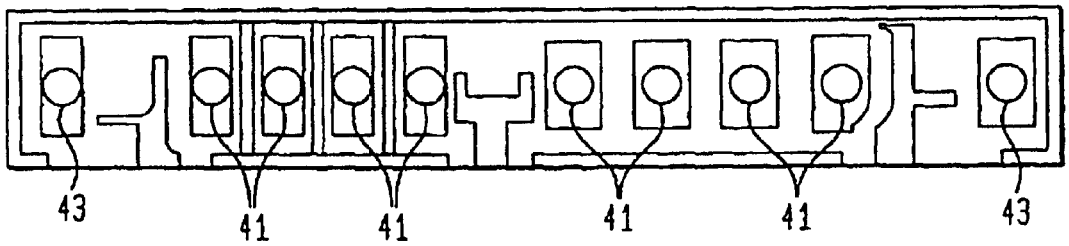
FIG. 4 (PRIOR ART)
FIG. 4 is a plan view of the top surface of one conventional dielectric ceramic filter with holes and traps positioned along a straight line.
Figure 5:
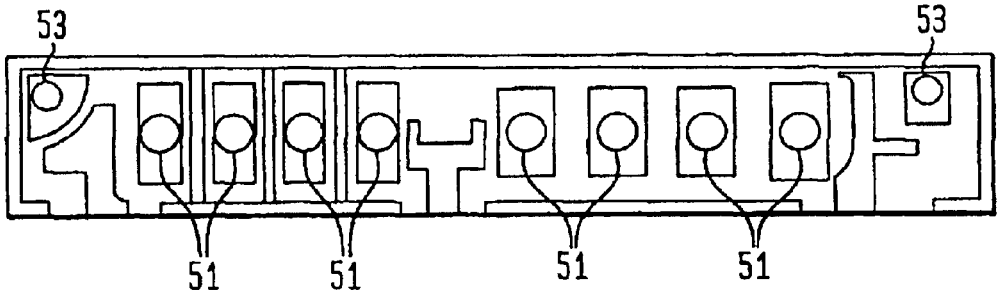
FIG. 5 illustrates one embodiment of the present invention with traps placed off-center and having reduced diameters FIG. 6 demonstrates the displacement of the trap from the holes in accordance with the present invention where the transmission poles have a circular cross section at the top surface of the filter.

Referring to FIG. 5, one embodiment of the present invention is shown wherein traps 53 are moved off the center line which bisects each of holes 51. In addition, the diameter of trap 53 is made smaller than the diameter of holes 51. The combination of these two adjustments allow the traps to be moved horizontally closer to the holes without effecting its performance. As a result any straight line block filter, with a given specification can be reduced in width.

Figure 6:
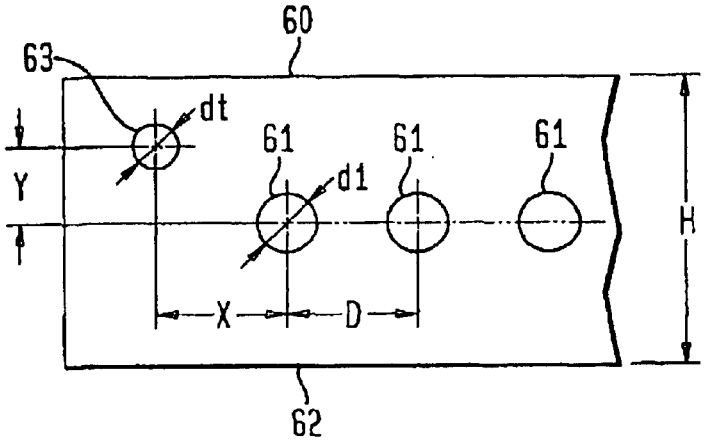

More specifically, as shown in FIG. 6, the horizontal space x between trap 63 and the nearest transmission pole, i.e., hole 61, approximates D where D is the distance between transmission poles 61. Preferably, the horizontal distance x should be no less than 0.8D and no greater than 1.5 D. This equals to a large savings in width w of the block filter with one trap on one end, and even more so for a filter with a trap on both ends of the linear array of transmission poles. Because the trap is placed off center, it has a vertical displacement y from the center line of the hole. Assuming the ceramic block has a height of H, as shown in FIG. 6, the holes 61 are centered across the height of the filter such that their center point lies 0.5H from both edge 60 and edge 62, the lowest point of the trap 63 should be at least above the highest point of the holes 61. In other words the trap and holes should not overlap vertically. In one preferred embodiment of the present invention, given a diameter of trap 63 of dt- and a diameter of holes 61 of d1, the vertical displacement of the trap 63 from the center line of holes 61 should preferably be not greater than (dt+d1)/2, but not greater than 3H/8.

Figure 7:
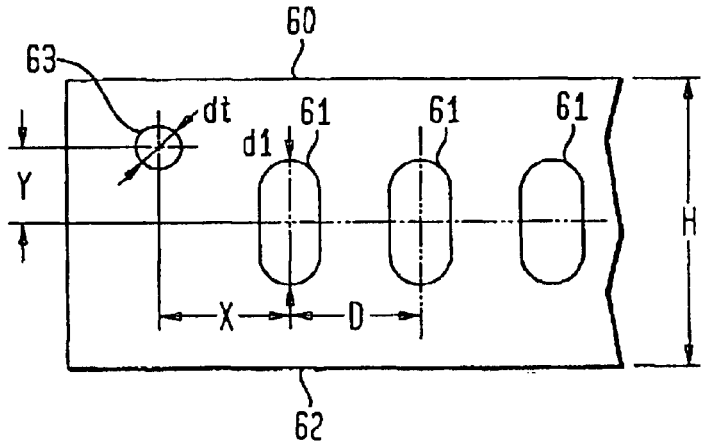
FIG. 7 demonstrates the displacement of the trap from the holes in accordance with the present invention where the transmission poles have an elliptical cross section at the top surface of the filter.

Referring to FIG. 7, where the holes 61 are elliptical in cross section, the vertical displacement of the trap 63 from the center line of holes 61 should still preferably be not greater than (dt+d1)/2, and not greater than 3H/8, where d1is the major diameter of the elliptical cross section.

Furthermore, as mentioned above the diameter of the trap hole should be reduced to a preferable range less than the diameter of the holes, but no less than 0.3 mm.

As with other dielectric filters the choice of dielectric is one of design. In one advantageous embodiment of the present invention, the dielectric is ceramic and has an effective dielectric constant between 20 and 150.

The manufacture of block filters is known in the art, including the process of laying the conductive material on the dielectric. As stated above, copper or silver are usually the conductive material of choice. The conductive material generally covers substantially all of the bottom and side walls of the ceramic block. This is accomplished by one of several known methods. These include dipping, spraying or printing a copper or silver paste onto the dielectric and firing the coated dielectric. Other methods include Electrolytic plating or Electroless plating, also processes known in the art.

Filters made in accordance with the present invention may be simplex (a single filter) or duplexer (the combination of two filters such as a transmitter filter and a receiver filter).

The foregoing merely illustrates the principles of the present invention. Those skilled in the art will be able to devise various modifications, which although not explicitly described or shown herein, embody the principles of the invention and are thus within its spirit and scope.

What is claimed is:

1. A filter, comprising:

a block of dielectric material having a top surface, a bottom surface, two opposing side-walls connecting said top surface to said bottom surface along the width of said block and two opposing side-walls connecting said top surface to said bottom surface along the height of said block;

at least three holes spaced along the width of said block and extending through said block from said top surface to said bottom surface, wherein at least one of said at least three holes which is relatively closer to one of said side-walls connecting said top surface to said bottom surface along said width of said block, is a trap hole and at least two adjacent holes of said at least three holes are transmission holes, said transmission holes spaced one from the other a distance D along the width of the block, and wherein the center of said trap hole is off the line bisecting the center of said transmission holes; and conductive material substantially covering said bottom surface said side-wall surfaces and said inner surfaces of said at least three holes.

2. The filter of claim 1 wherein said spacing along said width of said block, between said trap hole and said next nearest transmission hole is between 0.8D and 1.5D.

3. The filter of claim 2 wherein said spacing along said width of said block, between said trap hole and said next nearest transmission hole is between 0.8D and 1.2D.

4. The filter of claim 2 wherein said trap hole is spaced along said width of said block, from the next nearest transmission hole, a distance which is approximately D.

5. The filter of claim 1 wherein the center of said holes other than said trap holes lie substantially on a straight line.

6. The filter of claim 4 wherein the center of each of said transmission holes are spaced approximately 0.5H from the side-walls connecting said top surface to said bottom surface along said width dimension of said block filter.

7. The filter of claim 6 wherein said trap hole is spaced along said height of said block from said transmission holes, a distance not less than (dt+d1)/2, and no more than ⅜H, where dt is the diameter of said trap hole, d1 is the diameter of said transmission holes and H is the height dimension of said block.

* * * * *